US007594706B2

(12) United States Patent
Styka et al.

(10) Patent No.: US 7,594,706 B2
(45) Date of Patent: Sep. 29, 2009

(54) ADJUSTABLE SLIDING SINK DRAWER

(76) Inventors: Kimberly A. Styka, 2522 Renata Ct., Thousand Oaks, CA (US) 91362; Thomas A. Derrico, 2522 Renata Ct., Thousand Oaks, CA (US) 91362

( * ) Notice: Subject to any disclaimer, the term of this patent is extended or adjusted under 35 U.S.C. 154(b) by 331 days.

(21) Appl. No.: 11/601,520

(22) Filed: Nov. 17, 2006

(65) Prior Publication Data

US 2007/0114893 A1 May 24, 2007

Related U.S. Application Data

(60) Provisional application No. 60/737,902, filed on Nov. 18, 2005.

(51) Int. Cl.
*E03C 1/18* (2006.01)

(52) U.S. Cl. ..... 312/228; 312/205; 312/348.1

(58) Field of Classification Search ..... 312/330.1, 312/348.1–348.4, 205, 228
See application file for complete search history.

(56) References Cited

U.S. PATENT DOCUMENTS

| | | | | | |
|---|---|---|---|---|---|
| 175,127 | A | * | 3/1876 | Marsh | 312/226 |
| 1,270,496 | A | | 6/1918 | Cimaglia | |
| 1,291,794 | A | * | 1/1919 | Droste | 5/308 |
| 1,684,589 | A | | 9/1928 | Kirts | |
| 1,853,989 | A | | 4/1932 | Nuebel | |
| 1,866,314 | A | | 7/1932 | Meldahl | |
| 2,376,032 | A | | 5/1945 | Clare | |
| 2,723,894 | A | | 11/1955 | Bartleson | |
| 2,907,487 | A | * | 10/1959 | Harrington | 220/8 |
| 3,272,583 | A | * | 9/1966 | Averdieck | 312/334.38 |
| 3,292,983 | A | | 12/1966 | Service | |
| 4,061,395 | A | * | 12/1977 | Boole | 297/188.11 |
| 4,241,963 | A | * | 12/1980 | Seidel | 312/228 |
| 4,624,502 | A | * | 11/1986 | Boole | 297/188.11 |
| 5,016,772 | A | * | 5/1991 | Wilk | 220/8 |
| 5,070,556 | A | * | 12/1991 | Gloger | 5/308 |
| D370,806 | S | | 6/1996 | Sklovsky | |
| 5,678,909 | A | * | 10/1997 | Cheng et al. | 312/348.2 |
| 5,947,573 | A | | 9/1999 | Tovar et al. | |
| 6,129,433 | A | * | 10/2000 | Rosenberg et al. | 312/348.3 |

(Continued)

FOREIGN PATENT DOCUMENTS

JP 2002360457 * 12/2002

(Continued)

*Primary Examiner*—Janet M Wilkens
(74) *Attorney, Agent, or Firm*—Cislo & Thomas, LLP

(57) ABSTRACT

An adjustable sliding sink drawer comprising a left side panel, a right side panel, a left front panel, a right front panel, a left center tray, and a right center tray. These panels and trays are shaped to permit insertion of the device, in a drawer-like manner, into a cavity adjacent to and partially surrounding the underside of a sink, particularly a bathroom sink. The panels and trays create a geometrically-shaped storage compartment, having a generally horizontal bottom and generally vertical side walls. Further, these panels and trays are slidably connected to permit the adjustable sliding sink drawer to occupy the entire breadth of the cavity adjacent to the sink, to fit around various sink widths and designs, and to occupy nearly all of the usable space between the sink and the walls of the cabinet in which the sink is mounted. Non-adjustable embodiments are also disclosed.

9 Claims, 4 Drawing Sheets

U.S. PATENT DOCUMENTS

| | | | | |
|---|---|---|---|---|
| D539,062 | S * | 3/2007 | Styka et al. | D6/510 |
| 7,198,339 | B2 * | 4/2007 | Baron | 312/228 |
| 2005/0099101 | A1 * | 5/2005 | Lowe | 312/228 |
| 2005/0230393 | A1 * | 10/2005 | Testa | 220/8 |

FOREIGN PATENT DOCUMENTS

| | | |
|---|---|---|
| JP | 2003299532 | * 10/2003 |
| JP | 2004113481 | * 4/2004 |
| JP | 2008264207 | * 11/2008 |

* cited by examiner

ADJUSTABLE SLIDING SINK DRAWER

CROSS-REFERENCES TO RELATED APPLICATIONS

This patent application claims the benefit of U.S. Provisional Patent Application Ser. No. 60/737,902 filed Nov. 18, 2005 for Sliding Bathroom Sink Drawer, which application is incorporated here by this reference.

TECHNICAL FIELD

This invention relates to storage compartments that slide in and out in a drawer-like manner, particularly those that are adjustable to fit in a given space.

BACKGROUND ART

Bathroom and kitchen countertops are often cluttered with the many gadgets and personal items that seem to gravitate to those areas. Oftentimes, storage cabinets typically found around bathroom and kitchen sinks are not sufficient to store all of these items. Additionally, in the typical sink cabinet design, the under-counter space around the basin portion of the sink is generally left open and is unused. Therefore, there exists a need to provide a storage compartment to utilize the space around the basin portion of the sink. Furthermore, because of the various sink shapes and sizes and the various sink cabinetry designs, there exists a need for the storage compartment to be adjustable to accommodate those various designs.

DISCLOSURE OF INVENTION

The present invention is directed to an adjustable sliding sink drawer for providing a drawer-like storage area to occupy all or most of the under-counter space around a sink, particularly a bathroom sink. The adjustable sliding sink drawer is particularly shaped to fit a cavity defined by the underside of a sink, the underside of the surface to which the sink is mounted (e.g., the countertop portion of a cabinet), and the vertical supports for the sink (e.g., the legs or side walls of the cabinet). An example of such a cavity is depicted in FIG. 1. By contrast, in traditional sink cabinet designs, this space is often open space, is merely closed off by a decorative panel, or remains otherwise unavailable as an area to store items.

In a version of the invention, the storage compartment has a front panel, a left side panel, a right side panel, a left rear panel, a right rear panel, a cutout panel, and a bottom panel. The combination of these elements forms an open-topped storage compartment having a bottom, closed sides, and a cutout in the storage compartment such that the storage compartment may fit around the washbasin.

The front panel is generally rectangular and has a top edge, a bottom edge, a left end, and a right end. The left side panel has a front end, a rear end, a top edge, and a bottom edge. The front end of the left side panel is connected to the left end of the front panel. The left side panel extends from the front panel in a generally perpendicular direction.

The right side panel has a front end, a rear end, a top edge, and a bottom edge. The front end of the right side panel is connected to the right end of the front panel. The right side panel extends from the front panel in the same generally perpendicular direction as the left side panel.

The left rear panel has a left end, a right end, a top edge, and a bottom edge. The left end of the left rear panel is connected to the rear end of the left side panel. The left rear panel extends from the left side panel in a generally perpendicular direction.

The right rear panel has a left end, a right end, a top edge, and a bottom edge. The right end of the right rear panel is connected to the rear end of the right side panel. The right rear panel extends from the right side panel in a generally perpendicular direction.

The cutout panel has a top edge and a bottom edge, and the cutout panel is connected to the right end of the left rear panel and the left end of the right rear panel. The cutout panel is shaped and dimensioned to fit around the washbasin.

The bottom panel is shaped and dimensioned to connect, and form a generally planar surface between, the bottom edges of each of the front panel, the left side panel, the right side panel, the left rear panel, the right rear panel, and the cutout panel.

The invention also provides a method of furnishing a storage compartment having the steps of providing a storage compartment as described above; connecting a first drawer glide roller to the left side panel and connecting a second drawer glide roller to the right side panel; connecting a first drawer glide rail to the underside of the countertop, the first drawer glide rail being in corresponding relation to the first drawer glide roller; connecting a second drawer glide rail to the underside of the countertop, the second drawer glide rail being in corresponding relation to the second drawer glide roller; positioning the storage compartment on the underside of the countertop such that the cutout panel fits around the basin portion of the sink; and connecting the first drawer glide roller to the first drawer glide rail and connecting the second drawer glide roller to the second drawer glide rail, such that the storage compartment may slide under the countertop and out from under the countertop.

The adjustable sliding sink drawer can be formed from wood, plastic, metal, wire, or similar materials; it can also be formed from a combination of such materials. The adjustable sliding sink drawer opens easily with or without drawer handles, and that ease of opening and closing is less likely to deteriorate with use than the hinged door design of some other devices. The adjustable nature of some embodiments of the invention permit the adjustable sliding sink drawer to be retrofitted to existing sink cabinets and around existing sinks, and take full advantage of the entire area under the existing sink cabinet top. Non-adjustable embodiments are also disclosed, and they are suitable, for example, in new sink cabinet installations.

BEST MODE FOR CARRYING OUT THE INVENTION

Figure 1:
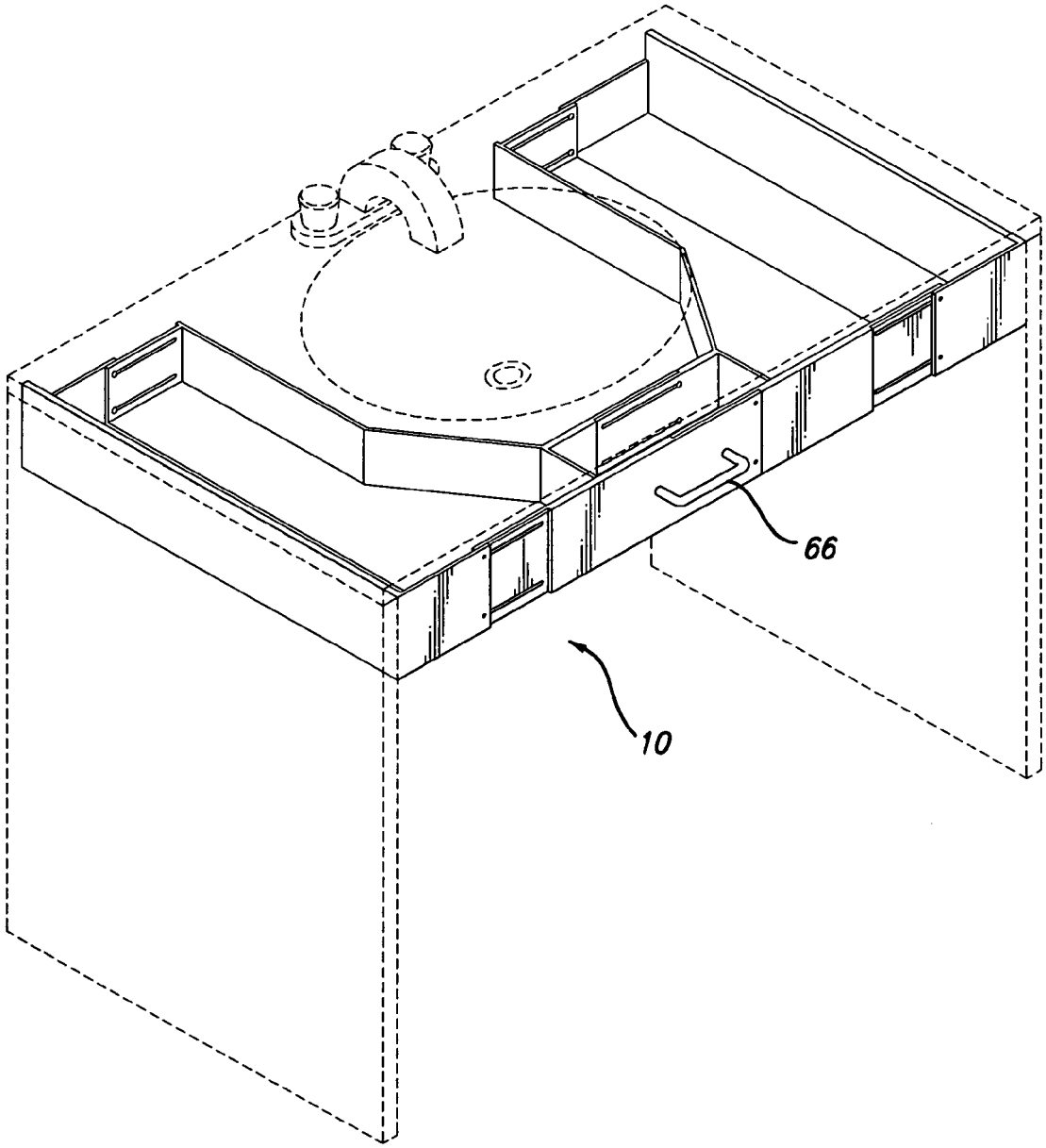
FIG. 1 is a perspective view of an embodiment of an adjustable sliding sink drawer installed adjacent to a bathroom sink.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the figures, in an embodiment of the invention an adjustable sliding sink drawer 10 has a left side panel 18, a right side panel 16, a left front panel 12, a right front panel 14, a left center tray 22, and a right center tray 20.

The left side panel 18, the right side panel 16, the left center tray 22, and the right center tray 20 are shaped to permit insertion of the embodiment, in a drawer-like manner, into a cavity adjacent to a sink, particularly a bathroom sink, such as that depicted in FIG. 1.

The left front panel 12 is generally rectangular and has a left and a right end. The right front panel 14 is also generally rectangular and has a left end and a right end. The left end of the right front panel 14 is slidably connected to the right end of the left front panel 12. In some embodiments, the left front panel 12 and right front panel 14 may be a generally continuous piece referred to as simply the front panel.

The right side panel 16 has a generally horizontal bottom surface 24, a generally vertical side wall 26 at a side edge of the horizontal bottom surface 24, a generally vertical rear wall 28 at a rear edge of the horizontal bottom surface 24, and a generally vertical front wall 30 at a front edge of the horizontal bottom surface 24. The side wall 26 and the rear wall 28 are each generally rectangular. The front wall 30 is slidably connected to the right end of the right front panel 14. The length of the right side panel 16 and the right center tray 20 each allows space for plumbing, the plumbing being generally at the rear of the under-counter space around the sink.

The right center tray 20 has a generally horizontal bottom surface 32 and a generally vertical wall 34 at a central edge of the right center tray 20. The right center tray 20 further has a rear end 36 and a front end 38. The horizontal bottom surface 32 of the right center tray 20 overlaps or underlaps at least a portion of the horizontal bottom surface 24 of the right side panel 16. The rear end 36 of the right center tray 20 is slidably connected to the rear wall 28 of the right side panel 16. The rear end 36 of the right center tray 20 and the rear wall 28 of the right side panel 16 define a right-side rear panel. In some embodiments, the right-side rear panel may be a generally continuous piece. The vertical wall 34 of the right center tray 20 is shaped and dimensioned to fit, preferably closely, around the right side of the basin portion of the sink.

The left center tray 22 has a generally horizontal bottom surface 40 and a generally vertical wall 42 at a central edge of the left center tray 22. The left center tray 22 further has a rear end 44 and a front end 46. The front end 46 of the left center tray 22 is slidably connected to the front end 38 of the right center tray 20. The vertical wall 42 of the left center tray 22 is shaped and dimensioned to fit, preferably closely, around the left side of the basin portion of the sink.

Figure 3:
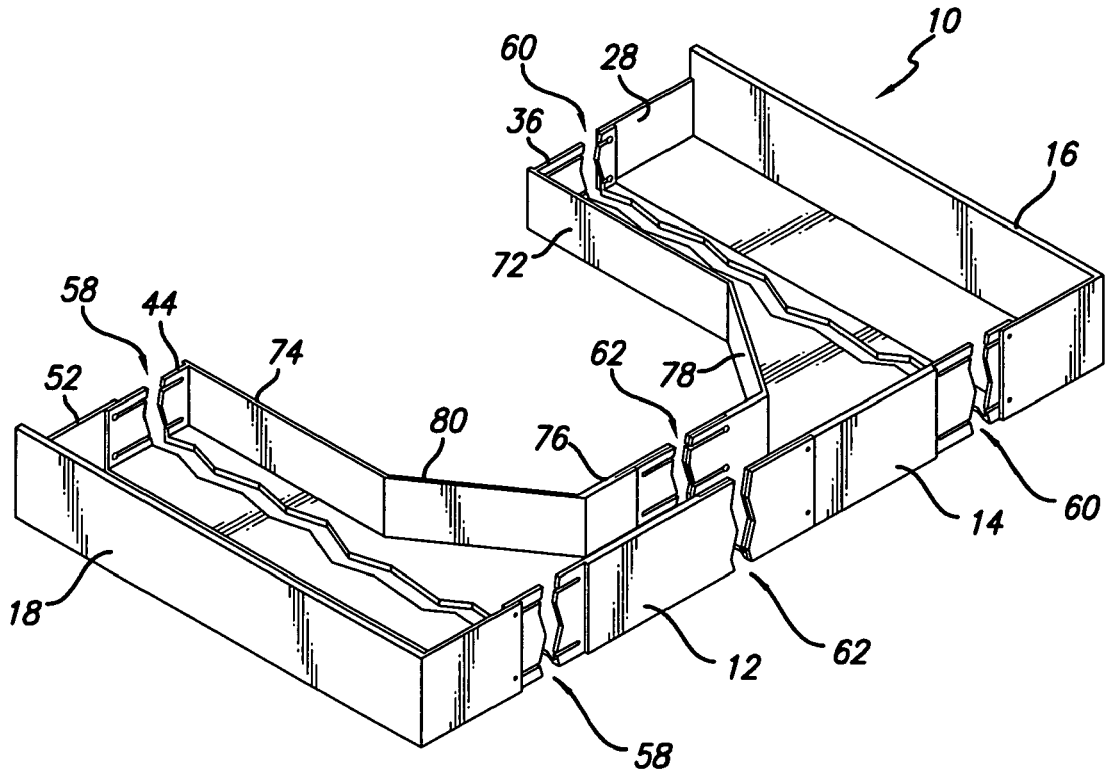
FIG. 3 depicts a perspective view of an embodiment of an adjustable sliding sink drawer showing an example of the adjustability illustrated in FIG. 2.
Figure 4:
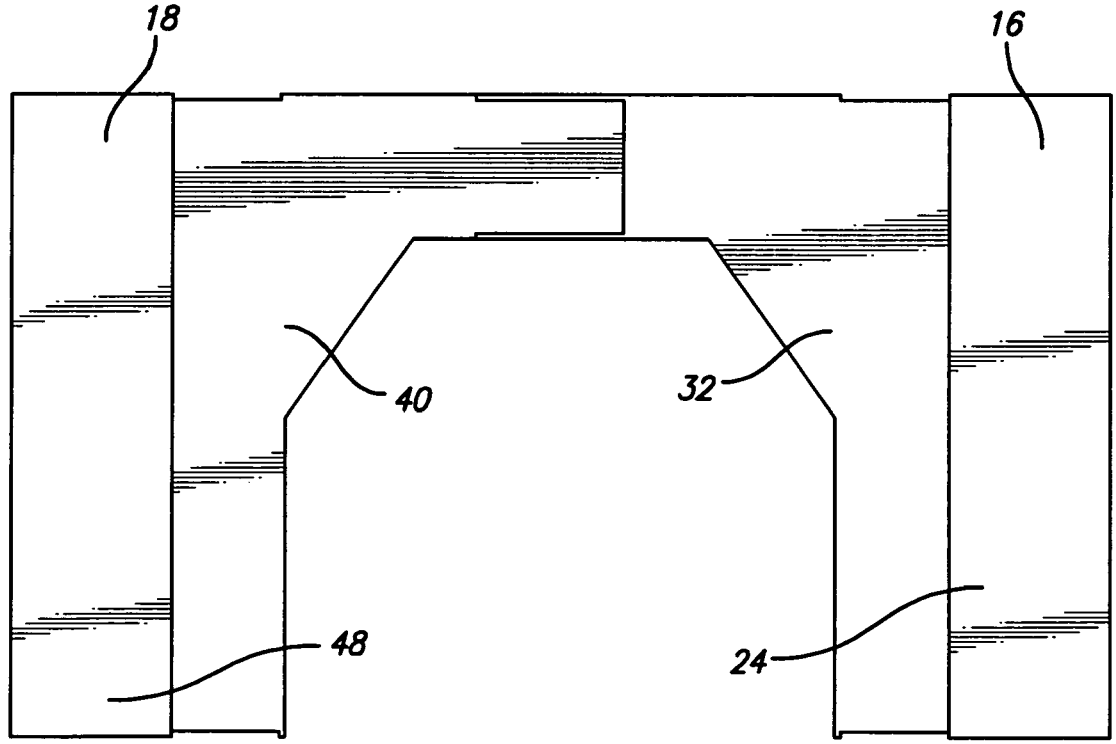
FIG. 4 depicts a plan view of the bottom of an embodiment of an adjustable sliding sink drawer.

The vertical wall 34 of the right center tray 20 and the vertical wall 42 of the left center tray 22 may be arc-shaped to partially surround the basin portion of the sink. In some embodiments, the vertical wall 34 of the right center tray 20 and the vertical wall 42 of the left center tray 22 may have a series of slats, the slats being connected end-to-end to at least partially suround the washbasin. Refer also to FIG. 3. In a version of such an embodiment, there are five generally rectangular slats. A first slat 72 is connected at a first end to the left end of the right-side rear panel (36, 28). The first slat 72 extends from the right-side rear panel (36, 28) in a generally perpendicular direction, the generally perpendicular direction being toward the front panel (12, 14). A second slat 74 is connected at a first end to the right end of the left-side rear panel (44, 52). The second slat 74 extends from the left-side rear panel (44, 52) in a generally perpendicular direction, the generally perpendicular direction being toward the front panel (12, 14). A third slat 76 has a right end and a left end. The third slat 76 is generally perpendicular to each of the first slat 72 and the second slat 74, and it is generally parallel to the front panel (12, 14). The third slat 76 is proximate the front panel (12, 14), relative to the first slat 72 and the second slat 74, which are each relatively farther away from the front panel (12, 14). A fourth slat 78 is connected to a second end of the first slat 72 and to the right end of the third slat 76. A fifth slat 80 is connected to a second end of the second slat 74 and to the left end of the third slat 76. The angle between the third slat 76 and the fourth slat 78 and the angle between the third slat 76 and the fifth slat 80 are each between 90 degrees and 180 degrees. Preferably, each of these angles is about 135 degrees. In another version of the invention, there are three slats that form three sides of a rectangle to partially surround the basin portion of the sink.

The vertical wall 34 of the right center tray 20 and the vertical wall 42 of the left center tray 22, whether arcuate, formed from slats, or otherwise formed, are also referred herein as the cutout panel. The cutout panel is connected to the right end of the left-side rear panel and the left end of the right-side rear panel, and the cutout panel is shaped and dimensioned to fit around a washbasin. Preferably, the cutout panel fits closely around the washbasin.

The left side panel 18 has a generally horizontal bottom surface 48, a generally vertical side wall 50 at a side edge of the horizontal bottom surface 48, a generally vertical rear wall 52 at a rear edge of the horizontal bottom surface 48, and a generally vertical front wall 54 at a front edge of the horizontal bottom surface 48. The rear end 44 of the left center tray 22 is slidably connected to the rear wall 52 of the left side panel 18. The rear end 44 of the left center tray 22 and the rear wall 52 of the left side panel 18 define a left-side rear panel. In some embodiments, the left-side rear panel may be a generally continuous piece. The front wall 54 is slidably connected to the left end of the left front panel 12. The horizontal bottom surface 40 of the left center tray 22 overlaps or underlaps at least a portion of the horizontal bottom surface 48 of the left side panel 18. As with the right side panel 16 and the right center tray 20, the length of the left side panel 18 and the left center tray 22 each allows space for plumbing, the plumbing being generally at the rear of the under-counter space around the sink.

Figure 6:
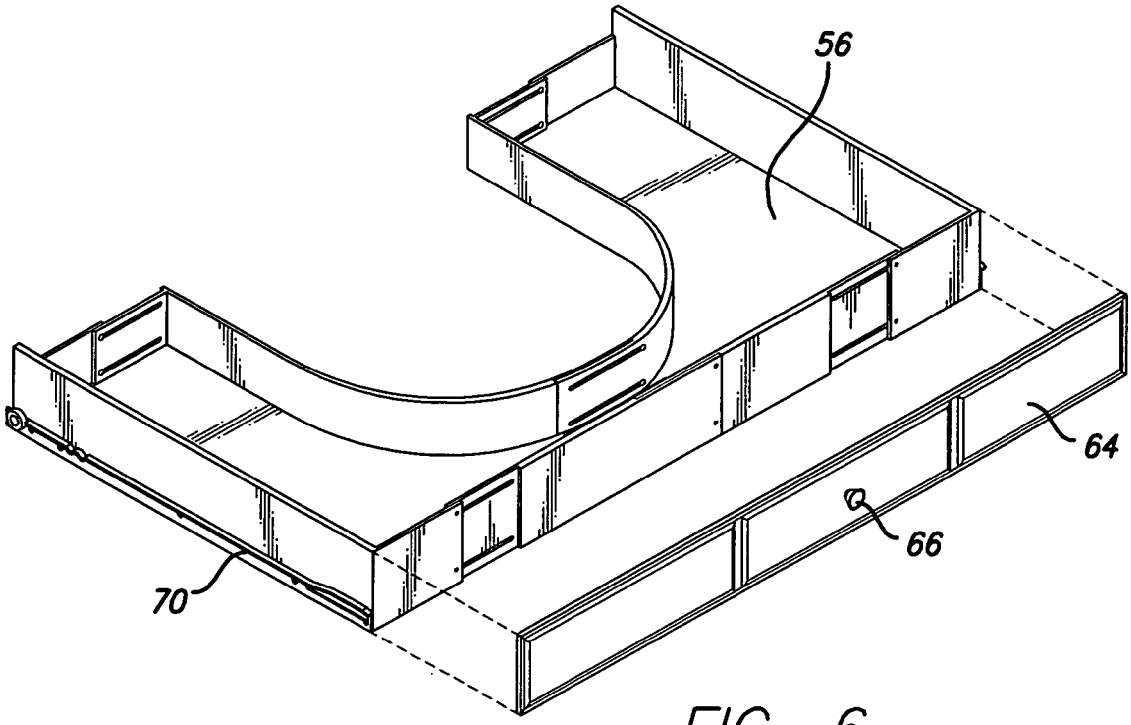
FIG. 6 is a perspective view of an embodiment of an adjustable sliding sink drawer.

In other versions of the invention, the left side panel 18, the right side panel 16, the left center tray 22, and the right center tray 20 may each have a generally vertical wall, each having a bottom edge. A separate bottom panel 56 may be cut to fit between them, connecting the bottom edges, once the adjustable sliding sink drawer 10 has been sized to fit the particular sink and cabinet geometry. FIG. 6 depicts one such embodiment.

In a version of the invention, the vertical wall 34 of the right center tray 20 and the vertical wall 42 of the left center tray 22 are each lower in height than the vertical side wall 26 of the right side panel 16 or the vertical side wall 50 of the left side panel 18. This height difference may help permit the adjustable sliding sink drawer 10 to fit around various sink geometries. In other versions, each of those heights may be the same.

The slidable connections and geometries of the components permit the adjustable sliding sink drawer 10 to expand to occupy the entire cavity adjacent to the sink and further permit the adjustable sliding sink drawer 10 to fit around various sink widths and designs. The slidable connections and component geometries also allow the adjustable sliding sink drawer 10 to occupy nearly all of the usable space between the sink and the walls of the cabinet in which the sink is mounted.

In this way, the adjustable sliding sink drawer 10 converts the otherwise unused cavity around a sink into a storage compartment. Specifically, the combination of the left side panel 18, the right side panel 16, the left front panel 12, the right front panel 14, the right center tray 20, and the left center tray 22 creates a geometrically-shaped storage compartment, having a generally horizontal bottom and generally vertical side walls, within the adjustable sliding sink drawer 10. In a version of the invention, vertical dividers 68 or partitions within the storage compartment may create a plurality of storage areas. See, as an example, FIG. 5. In other versions, there are no partitions, and the entire drawer 10 is one continuous storage compartment.

The left side panel 18 and right side panel 16 may each further have a drawer glide 70. The drawer glides 70 are of the types known in the art and permit a drawer to slide open and closed, for example, by using a wheel or roller that rides on one or more rails. The closed position, in which the adjustable sliding sink drawer 10 is slid under the countertop, is as depicted in FIG. 1. The open position, where the adjustable sliding sink drawer 10 is slid out from under the countertop, permits access to the storage compartment within the adjustable sliding sink drawer 10.

Figure 2:
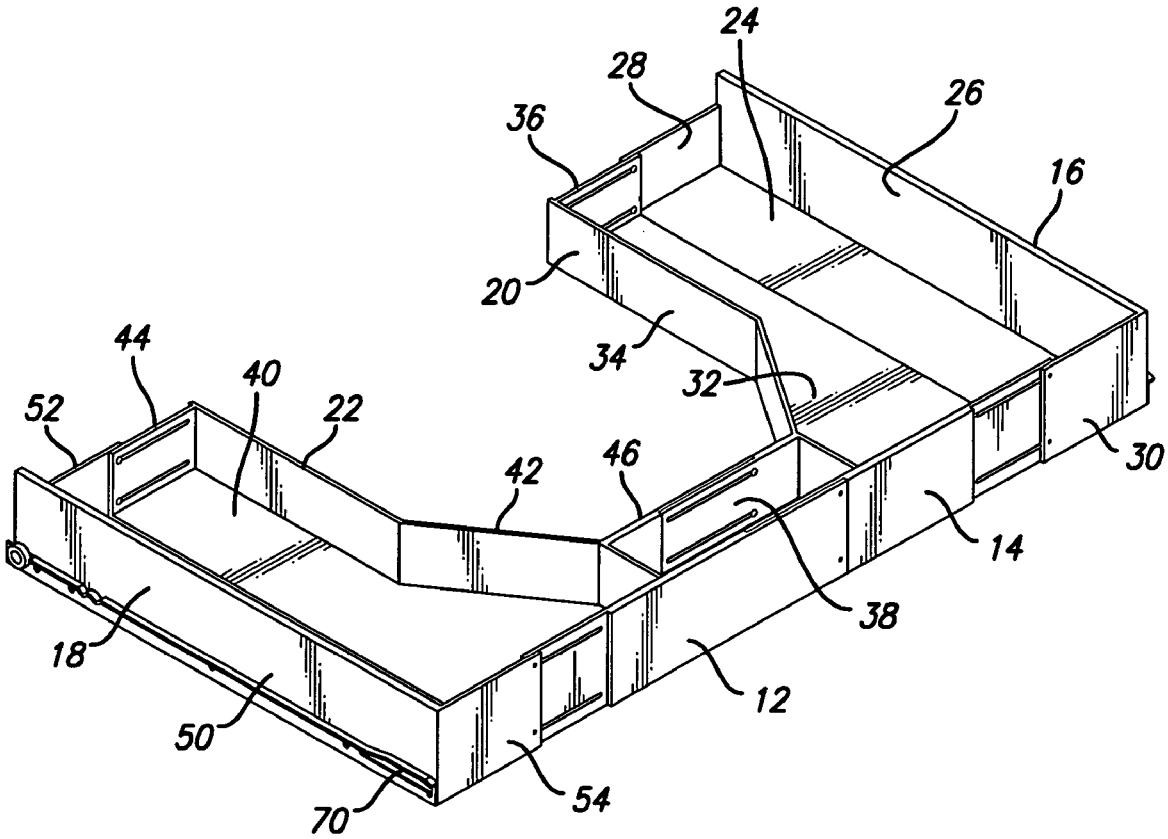
FIG. 2 is a perspective view of an embodiment of an adjustable sliding sink drawer.

FIG. 3 depicts the slidable connections in versions of the invention. The first extensible region 58 graphically depicts the adjustability as depicted in FIG. 2 between the left side panel 18, the left front panel 12, and the left center tray 22. The second extensible region 60 graphically depicts the adjustability as depicted in FIG. 2 between the right side panel 16, the right front panel 14, and the right center tray 20. The third extensible region 62 graphically depicts the adjustability as depicted in FIG. 2 between the left front panel 12, the right front panel 14, the left center tray 22, and the right center tray 20. In some versions of the invention, one or both of the slideable connections depicted by the first extensible region 58 and the second extensible region 60 may not be present. In some versions of the invention, the slideable connections depicted by the third extensible region 62 may not be present. Although depicted as pairs of slots and screws, where the screws push through the overlapping pieces, the slidable connections could have other structures. For example, the screws could be replaced by dowels or the slidable connections could simply be overlapping flat surfaces or tongue and groove connections.

While FIG. 3 depicts extensible regions that permit the adjustable sliding sink drawer 10 to adjust in width, other extensible areas are equally contemplated within the scope of this invention. For example, extensible regions may exist within the side panels (16, 18) and the center trays (20, 22) to permit the adjustable sliding sink drawer 10 to adjust in depth. Likewise, in some embodiments the height of the side panels (16, 18), the front panels (12, 14), or the center trays (20, 22) may be adjustable. In an embodiment of the invention, once configured and sized to fit a particular sink and cabinet, the slidable connections are locked, glued, fastened, tightened, or otherwise fixed to prevent their further adjustment during normal use of the adjustable sliding sink drawer 10. One benefit of the screw and slot configuration, illustrated in FIG. 2, is that the drawer continues to be adjustable if the consumer later chooses to use the drawer in another cabinet.

Figure 5:
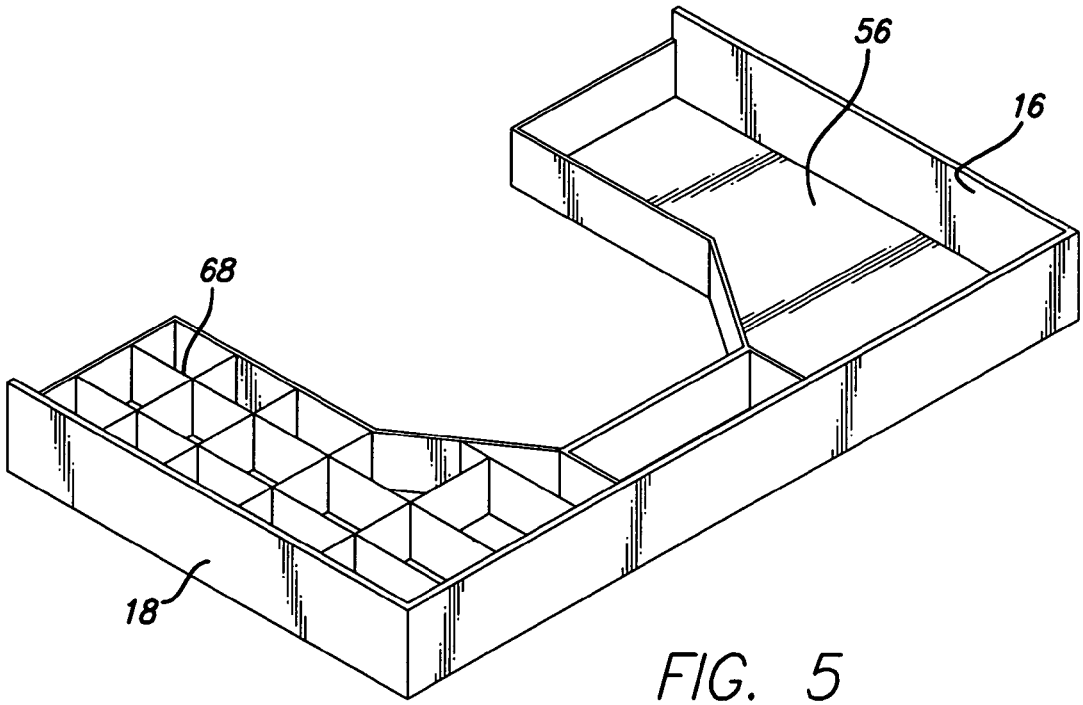
FIG. 5 depicts a perspective view of an embodiment of a sliding sink drawer in which the components are not adjustable.

FIG. 5 depicts a version of the invention where the components are not slidably connected. Instead, the dimensions of the sliding sink drawer 10 are predetermined to permit installation around a given sink and cabinet geometry. Additionally, in this version of the invention, wholesalers of the drawer could be provided with a plurality of non-adjustable drawers of various sizes to retrofit various cabinet sizes.

The adjustable sliding sink drawer 10 may further have a decorative panel 64 or facade to cover the left front panel 12 and the right front panel 14 and provide a handle 66 for opening the adjustable sliding sink drawer 10. Several different decorative panels 64 could be provided to match various sink cabinets. Alternatively, the consumer may use an existing decorative panel 64 or facade from their sink cabinet to cover the left front panel 12 and the right front panel 14 after installation of the adjustable sliding sink drawer 10. Existing facades may also be provided with a handle 66 for sliding open the adjustable sliding sink drawer 10. This latter option may be a savings of material cost for the consumer and helps to ensure that the decorative panel 64 matches the remainder of the cabinet. In some versions, the handle 66 may be attached directly to the front panel of the adjustable sliding sink drawer 10.

The invention also provides a method of furnishing a storage compartment having the steps of providing a storage compartment as described above; connecting a first drawer glide roller to the left side panel and connecting a second drawer glide roller to the right side panel; connecting a first drawer glide rail to the underside of the countertop, the first drawer glide rail being in corresponding relation to the first drawer glide roller; connecting a second drawer glide rail to the underside of the countertop, the second drawer glide rail being in corresponding relation to the second drawer glide roller; positioning the storage compartment on the underside of the countertop such that the cutout panel fits around the basin portion of the sink; and connecting the first drawer glide roller to the first drawer glide rail and connecting the second drawer glide roller to the second drawer glide rail, such that the storage compartment may slide under the countertop and out from under the countertop.

Although a variety of dimensions are suitable and adjustability to fit a variety of sink and cabinet geometries is an important feature of many embodiments of the invention, the dimensions given in the following paragraphs were found to be useful by the inventors:

In a version of the invention, the front panel (12, 14) has a length of about 20¾ inches and a height of about 3¾ inches; the left side panel 18 has a length of about 15½ inches and a height of about 3¾ inches; the right side panel 16 has a length of about 15½ inches and a height of about 3¾ inches; the left rear panel (44, 52) has a length of about 3⅞ inches and a height of about 2½ inches; the right rear panel (28, 36) has a length of about 3⅞ inches and a height of about 2½ inches;

and the distance between the right end of the left rear panel (44, 52) and the left end of the right rear panel (28, 36) is about 13 inches.

In a version where the vertical wall 34 of the right center tray 20 and the vertical wall 42 of the left center tray 22 have a series of five slats, the first slat 72 and the second slat 74 each may have a length of about 7¾ inches and a height of about 2½ inches; the third slat 76 may have a length of about 7 inches and a height of about 2½ inches; the fourth slat 78 and the fifth slat 80 may each having a length of about 5¼ inches and a height of about 2½ inches; and the angle between the third slat 76 and the fourth slat 78 as well as the angle between the third slat 76 and the fifth slat 80 are each about 135 degrees.

In an adjustable version of the invention, the length of the front panel (12, 14) may be adjustable between about 20¾ inches and about 28¾ inches; and the length of one or both of the right rear panel (28, 36) and the left rear panel (44, 52) may be adjustable between about 3⅞ inches and about 6⅜ inches. In versions having a series of five slats for the vertical wall 34 of the right center tray 20 and the vertical wall 42 of the left center tray 22, the length of the third slat 76 may be adjustable between about 7 inches and 10 inches. In versions having an arcuate cutout panel, the corresponding portion of the arc-shaped wall may similarly be adjustable.

While the present invention has been described with regards to particular embodiments, it is recognized that additional variations of the present invention may be devised without departing from the inventive concept.

INDUSTRIAL APPLICABILITY

This invention can be industrially applied to the development, manufacture, and use of storage compartments that slide in and out in a drawer-like manner, particularly those that are adjustable to fit in a given space.

What is claimed is:

1. An adjustable storage compartment for use in the under-counter space around a sink mounted on a countertop, the sink having a basin portion, the adjustable storage compartment comprising:

(a) a left front panel being generally rectangular and having a left and a right end;

(b) a right front panel being generally rectangular and having a left and a right end, the left end of the right front panel being slidably connected to the right end of the left front panel;

(c) a right side panel having a generally horizontal bottom surface, a generally vertical side wall at a side edge of the horizontal bottom surface, a generally vertical rear wall at a rear edge of the horizontal bottom surface, and a generally vertical front wall at a front edge of the horizontal bottom surface, the side wall and the rear wall each being generally rectangular, the front wall being slidably connected to the right end of the right front panel;

(d) a right center tray having a generally horizontal bottom surface, a generally vertical wall at a central edge of the right center tray, and further having a rear end and a front end, the horizontal bottom surface of the right center tray overlapping or underlapping at least a portion of the horizontal bottom surface of the right side panel, the rear end of the right center tray being slidably connected to the rear wall of the right side panel, the rear end of the right center tray and the rear wall of the right side panel defining a right-side rear panel, the vertical wall of the right center tray being shaped and dimensioned to fit around a right half of the basin portion of the sink;

(e) a left center tray having a generally horizontal bottom surface and a generally vertical wall at a central edge of the left center tray and further having a rear end and a front end, the front end of the left center tray being slidably connected to the front end of the right center tray, the vertical wall of the left center tray being shaped and dimensioned to fit around a left half of the basin portion of the sink; and (f) a left side panel having a generally horizontal bottom surface, a generally vertical side wall at a side edge of the horizontal bottom surface, a generally vertical rear wall at a rear edge of the horizontal bottom surface, and a generally vertical front wall at a front edge of the horizontal bottom surface, the rear end of the left center tray being slidably connected to the rear wall of the left side panel, the rear end of the left center tray and the rear wall of the left side panel defining a left-side rear panel, the front wall being slidably connected to the left end of the left front panel, the horizontal bottom surface of the left center tray overlapping or underlapping at least a portion of the horizontal bottom surface of the left side panel;

wherein the slidable connections permit the adjustable storage compartment to expand to occupy the under-counter space around the sink and to fit around various sink widths and geometries.

2. The adjustable storage compartment of claim 1, the vertical wall of the right center tray and the vertical wall of the left center tray each being arcuate.

3. The adjustable storage compartment of claim 1, the vertical wall of the right center tray and the vertical wall of the left center tray each being in three sections, a first section being generally parallel to the side wall of the respective right side panel or left side panel, a second section being generally parallel to the respective right front panel or left front panel, and a third section connecting the first section to the second section, the third section being generally at an obtuse angle to each of the first section and the second section, the third section of the right center tray coinciding with the front end of the right center tray and the third section of the left center tray coinciding with the front end of the left center tray.

4. The adjustable storage compartment of claim 3, each first section having a length of about 7¾ inches, both second sections combining for a length of about 7 inches, each third section having a length of about 5¼ inches, the angle between the first section and the connected third section being about 135 degrees, the angle between the second section and the connected third section being about 135 degrees.

5. The adjustable storage compartment of claim 1, the left front panel and the right front panel having a combined length of about 20¾ inches; the side wall of the right side panel and the side wall of the left side panel each having a length of about 15½ inches; the right-side rear panel and the left-side rear panel each having a length of about 3⅞ inches; the side wall of the right side panel, the side wall of the left side panel, the left front panel, and the right front panel each having a height of about 3¾ inches; the vertical wall of the right center tray and the vertical wall of the left center tray each having a height of about 2½ inches, and the right-side rear panel and the left-side rear panel each having a height of about 2½ inches.

6. The adjustable storage compartment of claim 5, the left front panel and the right front panel being adjustable to a combined length of between about 20¾ inches and about 28¾ inches; the right-side rear panel being adjustable to a length of between about 3⅞ inches and 6⅜ inches; and the left-side rear panel being adjustable to a length of between about 3⅞ inches and 6⅜ inches.

7. The adjustable storage compartment of claim 1 further comprising a left drawer glide connected to the side wall of the left side panel and a right drawer glide connected to the side wall of the right side panel, the left drawer glide and the right drawer glide permitting the adjustable storage compartment to be slid into the under-counter space or out from the under-counter space for access to the adjustable storage compartment.

8. A storage compartment, particularly for use around a washbasin, comprising:

(a) a front panel, the front panel being generally rectangular, having a length and a height, having a top edge and a bottom edge, and having a left end and a right end;

(b) a left side panel having a front end and a rear end and having a top edge and a bottom edge, the front end being connected to the left end of the front panel, the left side panel extending from the front panel in a generally perpendicular direction;

(c) a right side panel having a front end and a rear end and having a top edge and a bottom edge, the front end being connected to the right end of the front panel, the right side panel extending from the front panel in the same generally perpendicular direction as the left side panel;

(d) a left rear panel having a length, having a left end and a right end, and having a top edge and a bottom edge, the left end being connected to the rear end of the left side panel, the left rear panel extending from the left side panel in a generally perpendicular direction;

(e) a right rear panel having a length, having a left end and a right end, and having a top edge and a bottom edge, the right end being connected to the rear end of the right side panel, the right rear panel extending from the right side panel in a generally perpendicular direction;

(f) a cutout panel having a top edge and a bottom edge, the cutout panel being connected to the right end of the left rear panel and the left end of the right rear panel, the cutout panel being shaped and dimensioned to fit around the washbasin, the cutout panel comprising a plurality of slats, the plurality of slats being connected end-to-end to at least partially surround the washbasin, the plurality of slats comprising five generally rectangular slats:

(i) a first slat being connected at a first end to the left end of the right rear panel, the first slat extending from the right rear panel in a generally perpendicular direction, the generally perpendicular direction being toward the front panel;

(ii) a second slat being connected at a first end to the right end of the left rear panel, the second slat extending from the left rear panel in a generally perpendicular direction, the generally perpendicular direction being toward the front panel;

(iii) a third slat having a right end and a left end, being generally perpendicular to each of the first slat and the second slat, and being generally parallel to the front panel, the third slat being proximate the front panel relative to the first slat and the second slat;

(iv) a fourth slat being connected to a second end of the first slat and to the right end of the third slat;

(v) a fifth slat being connected to a second end of the second slat and to the left end of the third slat;

wherein an angle between the third slat and the fourth slat and an angle between the third slat and the fifth slat are each between 90 degrees and 180 degrees;

(g) and a bottom panel, the bottom panel being shaped and dimensioned to connect and form a generally planar surface between the bottom edges of each of the front panel, the left side panel, the right side panel, the left rear panel, the right rear panel, and the cutout panel;

wherein the combination of the front panel, the left side panel, the right side panel, the left rear panel, the right rear panel, the cutout panel, and the bottom panel forms an open-topped storage compartment having a bottom, closed sides, and a cutout in the storage compartment such that the storage compartment may fit around the washbasin.

9. The storage compartment of claim 8, the first slat and the second slat each having a length of about 7¾ inches and a height of about 2½ inches; the third slat having a length of about 7 inches and a height of about 2½ inches; the fourth slat and the fifth slat each having a length of about 5¼ inches and a height of about 2½ inches; the angle between the third slat and the fourth slat and the angle between the third slat and the fifth slat each being about 135 degrees.

* * * * *